US007041893B2

(12) United States Patent
Hasegawa et al.

(10) Patent No.: US 7,041,893 B2
(45) Date of Patent: May 9, 2006

(54) ELECTRONIC MUSICAL INSTRUMENT WITH CUSTOMIZATION OF AUXILIARY CAPABILITY

(75) Inventors: Yutaka Hasegawa, Hamamatsu (JP); Shuzo Karakawa, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 143 days.

(21) Appl. No.: 10/215,795

(22) Filed: Aug. 8, 2002

(65) Prior Publication Data

US 2003/0029303 A1 Feb. 13, 2003

(30) Foreign Application Priority Data

Aug. 9, 2001 (JP) ..... 2001-241982

(51) Int. Cl.
*G10H 7/00* (2006.01)
*G04B 13/00* (2006.01)

(52) U.S. Cl. ..... 84/609

(58) Field of Classification Search ..... 84/609, 84/634

See application file for complete search history.

(56) References Cited

U.S. PATENT DOCUMENTS

| | | | | |
|---|---|---|---|---|
| 5,880,386 | A * | 3/1999 | Wachi et al. | 84/601 |
| 5,941,711 | A | 8/1999 | Iida et al. | |
| 6,122,617 | A | 9/2000 | Tjaden et al. | |
| 6,160,213 | A * | 12/2000 | Arnold et al. | 84/615 |
| 6,226,672 | B1 * | 5/2001 | DeMartin et al. | 709/219 |
| 6,346,666 | B1 * | 2/2002 | Tsai et al. | 84/637 |
| 6,476,304 | B1 * | 11/2002 | Uehara | 84/600 |
| 6,495,747 | B1 * | 12/2002 | Shimaya et al. | 84/477 R |
| 2002/0002896 | A1 * | 1/2002 | Hasegawa | 84/609 |
| 2002/0035916 | A1 * | 3/2002 | Tsai et al. | 84/622 |
| 2003/0024376 | A1 * | 2/2003 | Gyoten et al. | 84/609 |
| 2003/0115349 | A1 * | 6/2003 | Brinkman et al. | 709/231 |
| 2003/0182100 | A1 * | 9/2003 | Plastina et al. | 704/1 |

FOREIGN PATENT DOCUMENTS

| | | |
|---|---|---|
| EP | 0777208 A1 | 6/1997 |
| EP | 0933906 A2 | 8/1999 |
| JP | 09-152988 | 6/1997 |
| JP | 10-063281 | 3/1998 |
| JP | 10-274919 | 10/1998 |
| JP | 09-292772 | 11/1998 |
| JP | 2001-272978 | 10/2001 |

OTHER PUBLICATIONS

European Search Report No. EP 02 01 7617, Examiner R. Pulluard, 2 pages.

* cited by examiner

*Primary Examiner*—Jeffrey W Donels
(74) *Attorney, Agent, or Firm*—Harness, Dickey & Pierce, P.L.C.

(57) ABSTRACT

An electronic musical instrument is operable to provide a music play and an associated capability utilized by users in association with the music play under different modes customized to the respective users. In the electronic musical instrument, an ID setting section sets identification information effective to identify each of the users. A managing section manages personal information containing a profile of each user in correspondence to the identification information of each user. A capability activating section operates when identification information of a particular user is designated for activating the capability under a mode customized for the particular user according to the personal information corresponding to the designated identification information.

14 Claims, 11 Drawing Sheets

ELECTRONIC MUSICAL INSTRUMENT WITH CUSTOMIZATION OF AUXILIARY CAPABILITY

BACKGROUND OF THE INVENTION

1. Industrial Field of the Invention

The present invention relates generally to an electronic musical instrument and a network system of electronic musical instruments and a server. More particularly, the present invention relates to an electronic musical instrument and a network system thereof, which are adapted to operate with associated capabilities customized suitably to each of individual users.

2. Prior Art

Conventionally, electronic musical instruments have a variety of capabilities associated to a main capability of music play. For example, an automatic play capability is provided to automatically play a music piece together with accompaniments in a genre preferred by users. Another capability is provided for allowing users to select a lessen music in matching with a training level during the course of learning a play skill of the musical instrument. Still another capability may be provided for allowing users to select a desired screen of a display from two or more setting screens for setting the musical instruments.

Sometimes, one set of the musical instrument is shared by two or more users at home or music school. In such a case, each user tunes up the associated capabilities of the musical instrument to his or her own preference. For example, each user selects the genre of automatic play music, adjusts the lessen music to his or her own training level, and reselects a desired setting screen in configurating the electronic musical instrument.

However, it takes time and labor for two or more users of the same set of the electronic musical instrument to redo its settings, which are different between the users. In addition, common use of the same set of the electronic musical instrument by two or more users makes it difficult to understand the settings made by other users. Further, each user must understand the associated capabilities suited to him or her, and must remember his or her own settings, thereby making it cumbersome to manage the electronic musical instrument and its settings.

SUMMARY OF THE INVENTION

It is therefore an object of the present invention to facilitate the use of various auxiliary capabilities associated to the electronic musical instruments as suited to users, thereby enhancing the user friendliness of the electronic musical instruments.

In carrying out the invention and according to one aspect thereof, there is provided an electronic musical instrument operable to provide a music play and an associated capability utilized by users in association with the music play under different modes customized to the respective users. The inventive electronic musical instrument comprises an ID setting section that sets identification information effective to identify each of the users, a managing section that manages personal information containing a profile of each user in correspondence to the identification information of each user, and a capability activating section that is operative when identification information of a particular user is designated for activating the capability under a mode customized for the particular user according to the personal information corresponding to the designated identification information.

According to the electronic musical instruments configured as described above, when the user sets ID information by the ID information setting section, the personal information corresponding to this ID information is managed by the personal information managing section. The personal information is profile information of the user including user's age, music of preference, music genre of preference, music carrier, and the number of lessons. The capability activating section appropriately sets capabilities according to the personal information. Therefore, when the user enters and specifies his ID information by the above-mentioned ID information setting section for example, the electronic musical instrument operates with the capabilities suitable for the user, thereby enhancing user friendliness. For example, even novice players may enter the personal information to use the electronic musical instrument on the basis of the simple settings suitable for them without the knowledge about the detailed settings of the electronic musical instrument.

Preferably, the inventive electronic musical instrument further comprises an input section that is operated by the user for inputting the personal information of the user to the managing section, preferably, the personal information is entered and set by the user.

Such an electronic musical instrument can allow the user to set more definite personal information.

In the inventive electronic musical instrument, preferably the managing section manages the personal information containing a log of sessions of the music play rendered by the user such that the sessions are counted into the personal information for use in customizing of the mode of the capability.

Such an electronic musical instrument can allow the storage of the play log such as the number of times that the lessons have been practiced.

In one expedience of the inventive electronic musical instrument, the capability activating section activates a training capability effective to assist in self-training of the music play under the mode customized to a training level of the particular user based on the personal information. In another expedience of the inventive electronic musical instrument, the capability activating section activates an automatic play capability effective to provide an automatic music play under the mode customized to a preference of the particular user based on the personal information.

Such an electronic musical instrument operates the training capability with a training level suitable for the user in matching with the user's self evaluation level and the number of times that the lessons have been practiced, thereby automatically upgrading the training level in accordance with user's skill.

In carrying out the invention and according to another aspect thereof, there is provided a system comprising a plurality of electronic musical instruments connected to a network, and a server for serving the electronic musical instruments through the network. The electronic musical instruments are operable by users to provide a music play and an associated capability utilized by users in association with the music play under different modes customized to the respective users. The server comprises a registering section that registers identification information effective to identify each of the users, a managing section that manages personal information containing a profile of each user in correspondence to the identification information of each user, and a configurating section that operates when identification information of a particular user is designated for configurating the electronic musical instrument of the particular user to activate the capability under a mode customized for the particular user according to the personal information corresponding to the designated identification information.

According to the inventive network system, when the user registers ID information through the ID information registering section, the personal information corresponding to this ID information is managed by the personal information managing section of the server. The server causes the electronic musical instrument to appropriately set the mode of the capability according to the personal information such as user's age, music of preference, music genre of preference, music carrier, and the number of lessons. Therefore, when the user enters and specifies his or her ID information, the electronic musical instrument operates the associated capabilities under the mode suitable for the user, thereby enhancing user friendliness. For example, even novice players may enter the personal information to use the electronic musical instrument on the basis of the simple settings suitable for them without the detailed knowledge about the settings of the electronic musical instrument.

In the inventive network, preferably, the electronic musical instrument has an input section that is operated by the user for inputting the personal information of the user to the server.

Such a network system allows the user to operate the electronic musical instrument with the capabilities suitable for the user, thereby enhancing user friendliness.

In the inventive network system, the managing section of the server manages the personal information containing a log of sessions of the music play rendered by the user such that the sessions are counted into the personal information for use in customizing of the mode of the capability.

Such a network system allows the storage of a play log in the server. The play log includes the number of times that the lessons have been practiced, lesson time, instrumental timbres used in the lessen, automatically played music, and other information about how the electronic musical instrument has been used.

In one expedient of the inventive network system, the configurating section configurates the electronic musical instrument to activate a training capability effective to assist in self-training of the music play under the mode customized to a training level of the particular user based on the personal information. In another expedient of the inventive network system, the configurating section configurates the electronic musical instrument to activate an automatic play capability effective to provide an automatic music play under the mode customized to a preference of the particular user based on the personal information.

Such a network system can present the training capability (or lesson software) with a training level suitable for the user in matching with the personal information such as a user's self evaluation level and the number of times that the lessons have been practiced, thereby automatically upgrading the training level in accordance with the user's skill.

It should be noted that "ID information" may be any form unless they are duplicative among the users. For the "ID information" in the network system, a combination of personal ID information and electronic musical instrument ID information (such as a device number for example) is appropriate. In this case, the electronic musical instrument ID information may be registered into the server along with the personal information. Because electronic musical instruments connected to the network may be recognized and discriminated from each other, it is no problem even if the personal ID information is duplicative among different electronic musical instruments.

"ID information" and "personal information" may be registered from the electronic musical instrument to the server. A communication terminal device may be connected to the network to register these information into the server in a separate communication. Alternatively, these information may be registered into the server by postal mail for example.

In the network system or the electronic musical instrument according to the invention, the processing may be executed to automatically provide the capability under the mode customized to the user upon starting the electronic musical instrument by entering the ID information by the user.

In the network system according to the invention, as the customization processing, candidates of lesson music titles may be controlled, which fits the mode of the capability of the electronic musical instrument to the user. For example, a genre of music that user wants to learn is known by his or her personal information, hence the candidates of music titles suitable for that user may be displayed according to the personal information.

As the customization processing for making the capabilities of the electronic musical instrument suitable to the user, menus to be displayed on the display screen of the electronic musical instrument may be set so as to fit to the particularity of the user.

In the electronic musical instrument according to the invention, various information associated with the musical instruments and music pieces may be stored in the server beforehand and the information suitable for the user in accordance with the personal information may be extracted by the server to distribute the extracted information to the electronic musical instrument. Further, index information such as URLs having contents information suitable for the user may be distributed from the server.

DETAILED DESCRIPTION OF THE INVENTION

This invention will be described in further detail by way of example with reference to the accompanying drawings. Now, referring to FIG. 1, there is shown a block diagram illustrating an electronic musical instrument and an network system as practiced as embodiments of the present invention, in which the Internet is used as a network 100. The network 100 is connected to a server (computer) 200, an electronic musical instrument 300, and a computer 400 to be operated by a user of this electronic musical instrument 300.

Figure 1:
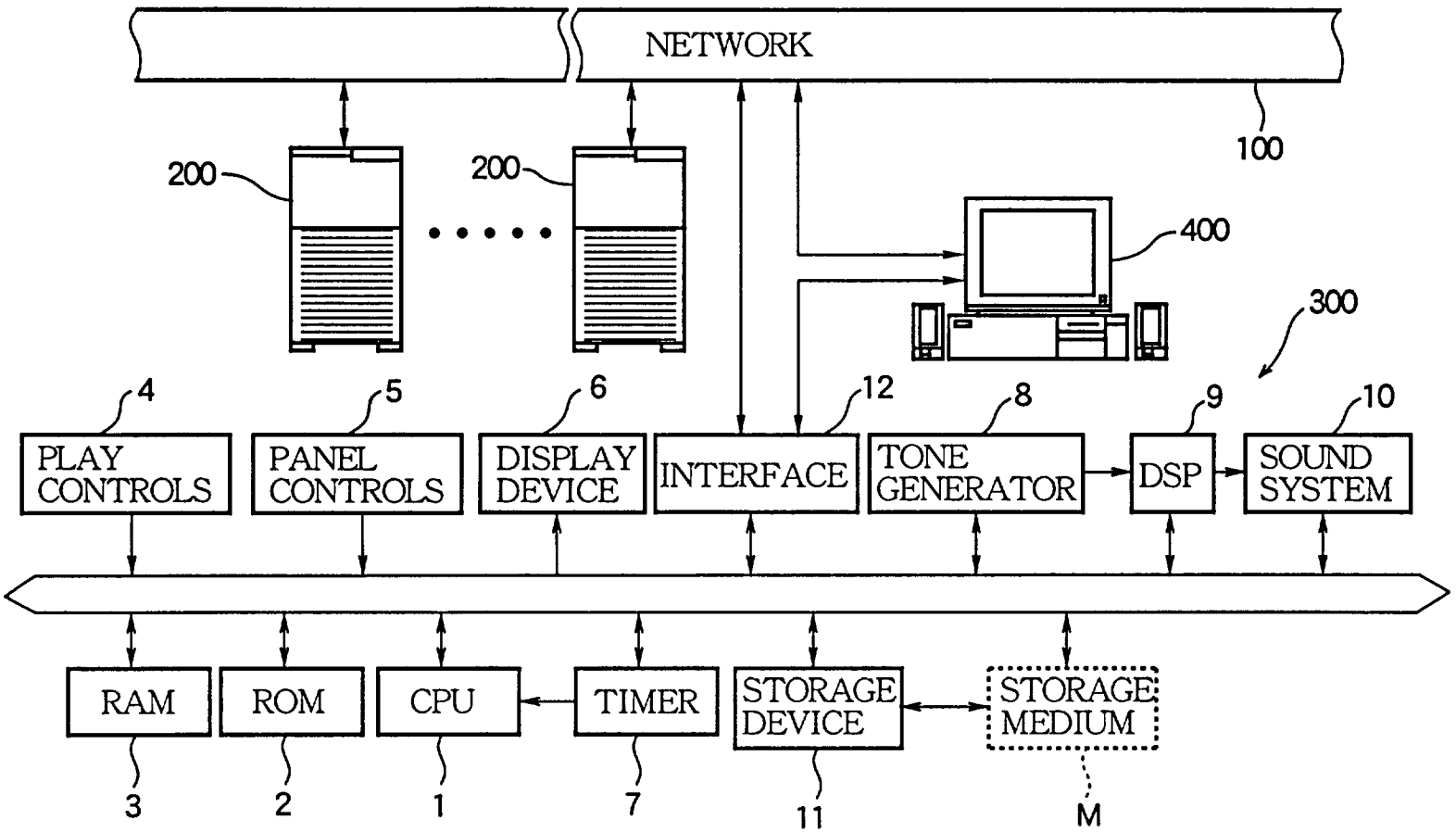
FIG. 1 is a block diagram illustrating an electronic musical instrument and a network system involving the electronic music instrument according to embodiments of the invention.

It should be noted that a first embodiment to be described later is an example in which the electronic musical instrument 300 manages user ID information (or ID number) and personal information (or individual information) and a second embodiment is an example in which the server 200 manages user ID information and personal information. These embodiments differ from each other only in the processing in the electronic musical instrument 300 and the server 200, their hardware configurations being the same as shown in FIG. 1.

As is well known, the network 100 is formed by many servers and many clients (the electronic musical instrument 300 and the computer 400 for example) through many providers based on an Internet protocol such as WWW (HTTP). Also, as is well known, the network 100 is connected to a plurality of devices such as network-compatible electronic devices, network-compatible computers of financial transaction institutions such as banks and credit card companies, and general clients such as personal computers which can use Web browsers.

A storage device providing a database of a computer of the server 200 is made of an incorporated or external HDD (Hard Disk Drive) for example, storing various programs including self-training software (lesson software) and performance data for various automatic play and lesson music for example. In the second embodiment, the storage device of this server 200 stores a database of the personal information (or individual information) of many users who use the electronic musical instrument 300 or the computer 400, along with their ID numbers (or ID information).

In the electronic musical instrument 300, a CPU 1 controls the entire electronic musical instrument by use of a work area in a RAM 3 on the basis of a control program stored in a ROM 2. As a basic function of a usual electronic musical instrument, the CPU 1 detects an operation event performed in play controls 4 such as a keyboard, thereby controlling manual play. In addition, the CPU 1 detects an operation event performed on panel controls such as switches, thereby performing selection and input processing in accordance with the operations of various switches. Further, the CPU 1 controls a display device 6 such as a liquid crystal display panel.

A timer 7 is a circuit for generating an interrupt signal when executing automatic play processing for example. A tone generator 8 generates tone signals in response to a key code, timbre data, and tone volume data supplied from the CPU 1. A DSP 9 adds effects to the tone signals in response to the settings supplied from the CPU 1 and outputs the resultant tone signals to a sound system 10. The sound system 10 performs D/A conversion and amplification for example on the tone signals and sounds them from a loudspeaker.

A storage device 11 is composed of a hard disk drive (HDD), a floppy disk drive (FDD), a CD-ROM device, a magneto-optical disc (MO) device, or a digital versatile disc (DVD) device for example. For the devices other than the HDD, data are transferred with various portable recording media M. For example, the storage device 11 is used to supply various data such as play data including various automatic music and lesson music. In the first embodiment, this storage device is used for storing user ID numbers and personal information.

An interface 12 is implemented by a modem or a terminal adapter. The electronic musical instrument 300 is connected to the Internet 100 or the computer 400 through the interface 12.

(First Embodiment)

Figure 2:
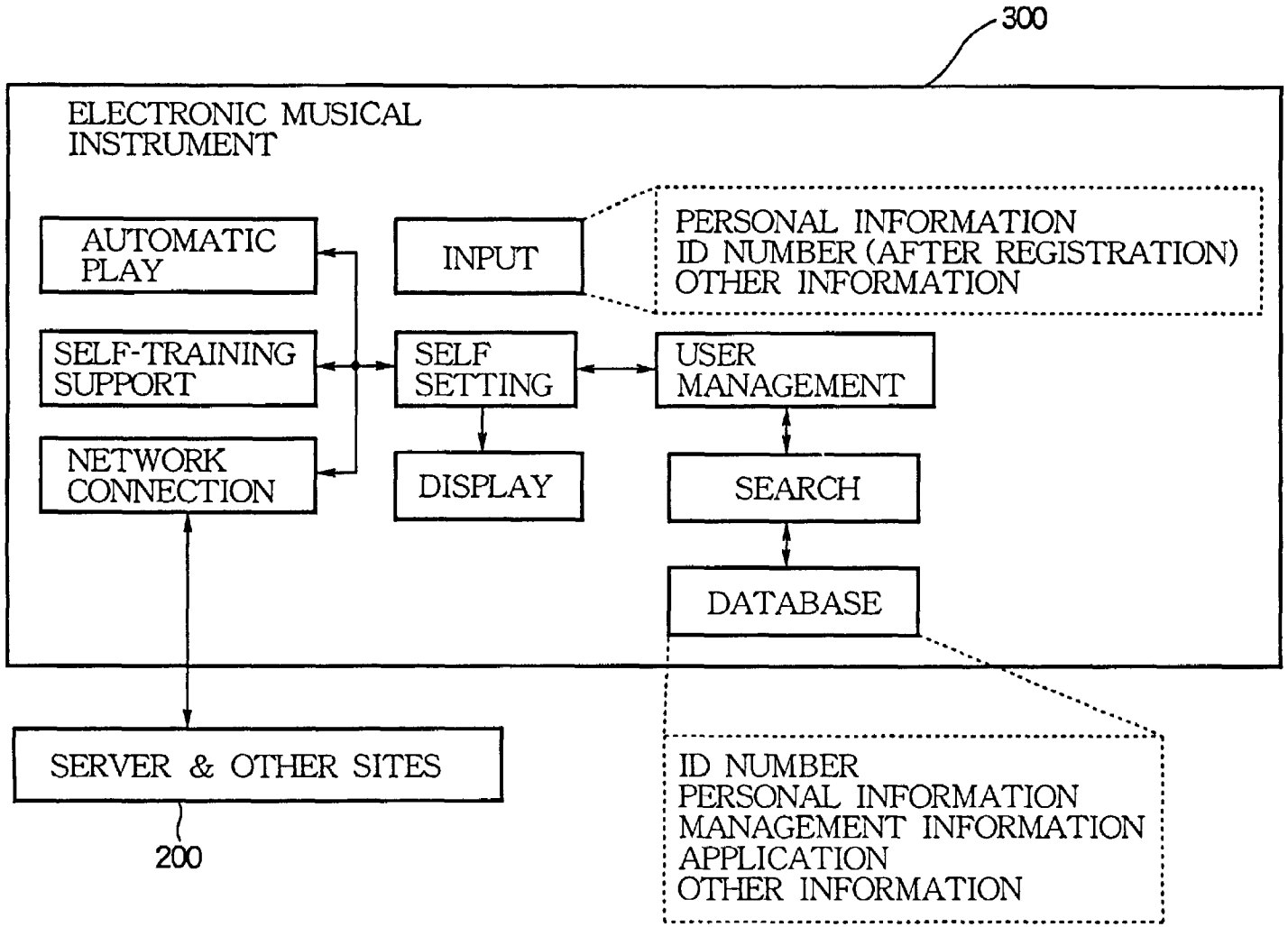
FIG. 2 is a functional block diagram illustrating the main configuration of a first embodiment.

Referring to FIG. 2, there is shown a functional block diagram illustrating the main configuration of the first embodiment. As shown, the functional blocks are configured by a computer based on the CPU 1, a control program, an input/output device, a storage device, and so on. The electronic musical instrument 300 has the capabilities of automatic play for reading play data for automatic play, self-training support for supporting users in learning the music based on self-training software, and network connection for connecting this electronic musical instrument to the network 100. These capabilities are set by a self setting capability.

For example, for the automatic play capability, the self setting capability displays music candidates which are suitable for a particular user, for example. For the self-training support capability, the self setting capability selects lesson music titles and lesson mode corresponding to user's training level. For the network connection capability, the self setting capability sets the URLs of target servers and sites to which this electronic musical instrument is connected, and connects the same to these servers and sites. For these purposes, the self setting capability searches the database by a user management capability and a search capability. The database stores registered ID numbers, personal information related to these ID numbers, management information related to these ID numbers, application software such as self-training software, and other information. The self setting capability reads from the database the personal information and management information corresponding to an ID number (a registered ID number) entered by an input capability, and sets the above-mentioned capabilities in accordance with the retrieved personal information and management information. It should be noted that the input capability allows the user to enter his or her personal information and other information.

Figure 3:
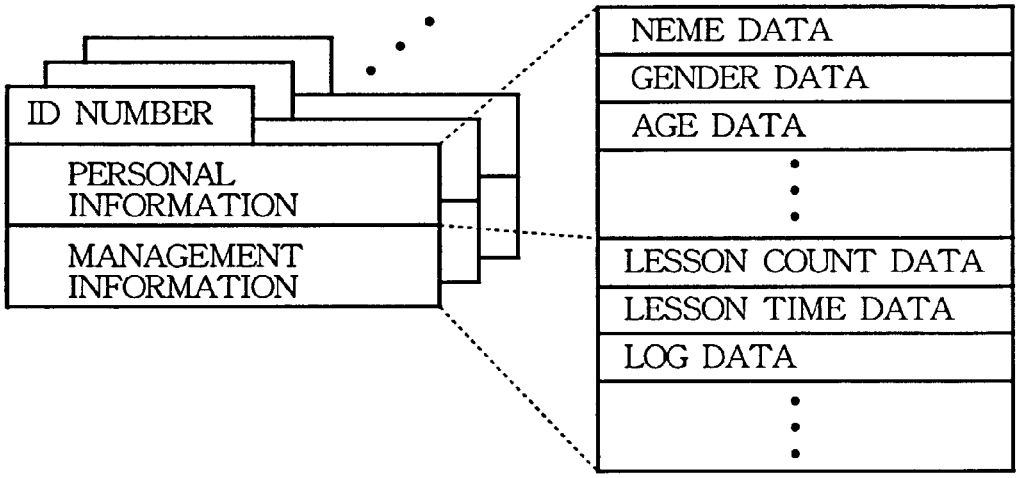
FIG. 3 is a diagram illustrating recorded contents of a database in the first embodiment.

Referring to FIG. 3, there is shown a diagram illustrating the main recorded contents of the database. As shown, the personal information and the management information are stored in correspondence with each registered ID number. The personal information includes name data indicative of the name of each registered user, gender data indicative of the gender of each user, and age data indicative of the age of each user, for example. The management information includes lesson count data indicative of the number of times each user has learned to play music by use of self-training software, lesson time data indicative of total lesson time, and log data indicative of automatic play reproduction log and operation log, for example.

Figure 4:
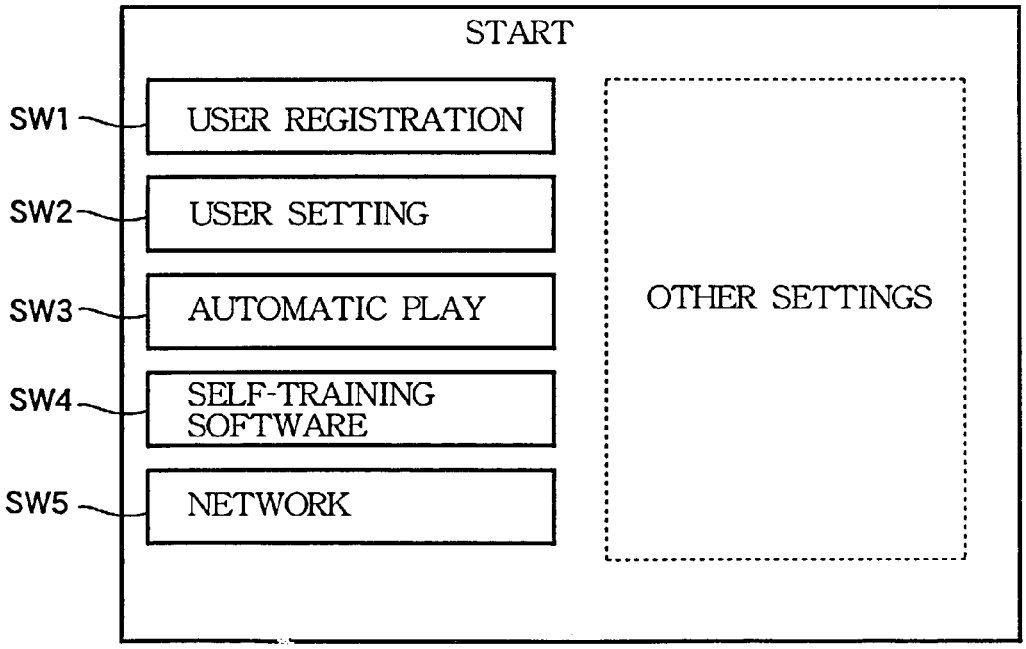
FIG. 4 is a diagram illustrating an exemplary initial input screen of a display in the first embodiment.
Figure 5:
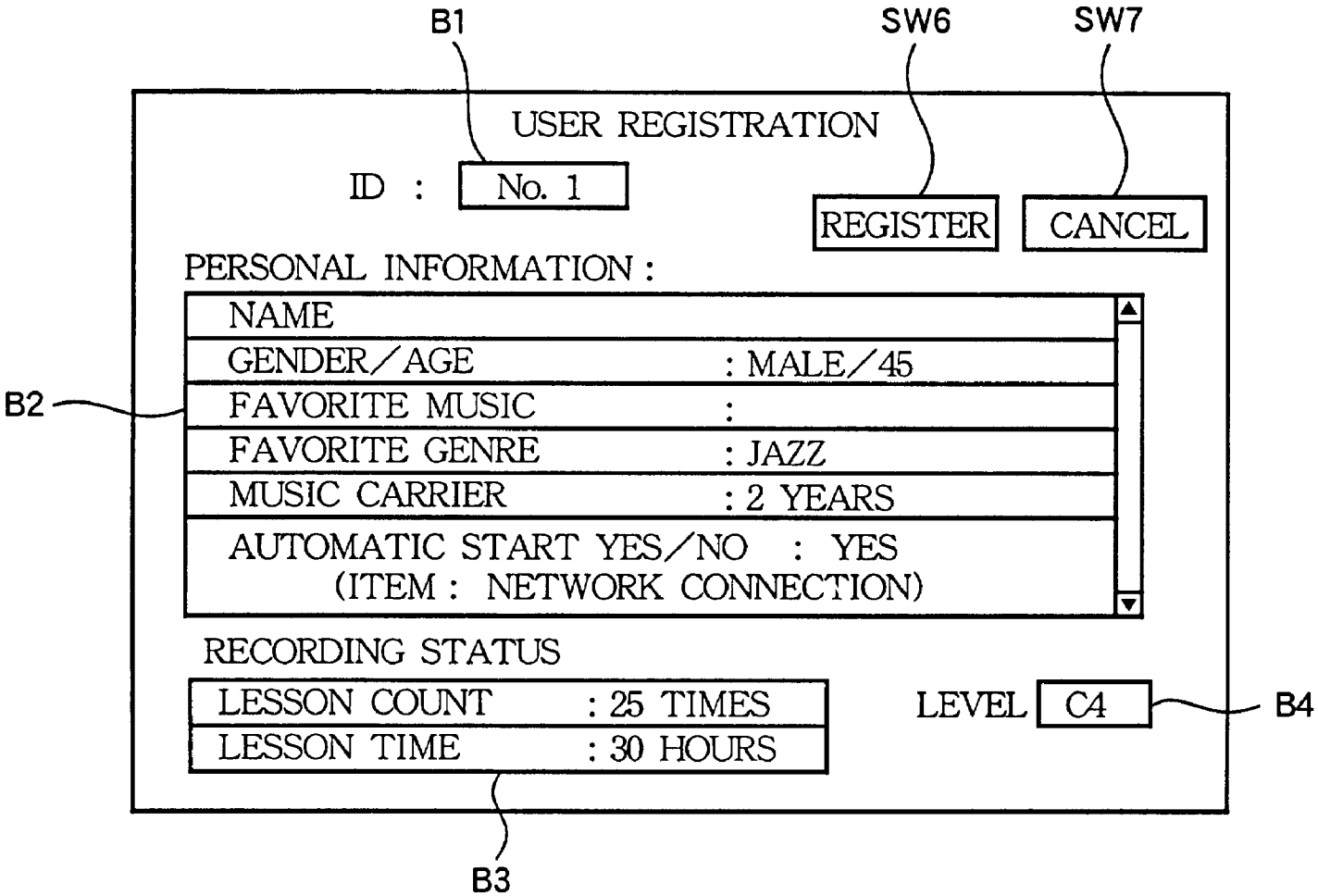
FIG. 5 is a diagram illustrating an exemplary user registration screen in the first embodiment.
Figure 6:
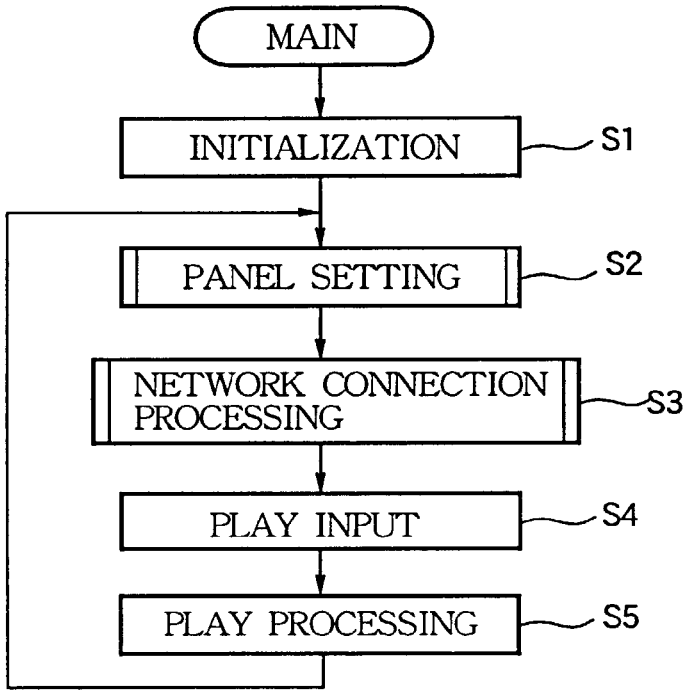
FIG. 6 is a flowchart describing the main processing of the first embodiment.

Referring to FIG. 4, there is shown a diagram illustrating an exemplary initial input screen of a monitor display provided by the input capability of the electronic musical instrument 300. FIG. 5 illustrates an exemplary user registration screen. The initial input screen shown in FIG. 4 is displayed on the display device 6 at the activation of the electronic musical instrument 300, for example. The displayed screen contains "User Registration" switch (a screen switch supported by GUI) SW1, "User Setting" switch SW2, "Automatic Play" switch SW3, "Self-training Software" switch SW4, "Network" switch SW5, and other switches for use in data setting. These switches are selected by moving a cursor to them by operating the panel controls 5.

First, when "User Setting" is selected, a screen shown in FIG. 5 appears. At this moment, the user management capability displays an unused (currently available) ID number (or ID information) in an ID display box B1. This allows the user to make confirmation of the ID number allocated to him. A digit number may also be entered in this ID display box B1. If the digit number entered is not in use for another ID number, the entered number may be registered as an ID number.

The user may enter "Name" and "Gender and Age" into "Personal Information" input box B2. The user may also set "Automatic Start Yes/No" for determining whether or not automatically starting a desired capability as the personal information at the start of the electronic musical instrument 300. When "Yes" is selected, the item of automatic start (in this example, the "Network Connection" capability) may be set. When the user selects "Register" switch SW6, the entered personal information is registered (or stored in the database) in correspondence with the ID number. To cancel the processing, the user selects "Cancel" switch SW7.

"Recording Status" display box B3 shown in FIG. 5 indicates the lesson count and lesson duration of time learned by the user. "Evaluation" display box B4 shows the training level decided by lesson results for example. These lesson count and duration of time and evaluation data are recorded to the above-mentioned management information as with various log information.

It should be noted that, in the first embodiment, each ID number is set to "1" or higher; if the number entered in ID display box B1 is "0," this allows the default setting of how the electronic musical instrument 300 should operate when it is powered with no user registered. Namely, the contents of normal initial start may be set in an input box, not shown.

When "User Setting" is selected in the initial screen shown in FIG. 4, a screen for entering the ID number appears, waiting for the user to enter his or her ID number. When the ID number is entered and, if automatic start "Yes" is selected, automatic play or self-training software or a network service starts in a mode suited to the personal information corresponding to the entered ID number.

On the other hand, "Automatic Play" switch SW3, "Self-training Software" switch SW4, and "Network" switch SW5 shown in FIG. 4 are selected by the user to select the capabilities which are started in case that the automatic start of the electronic musical instrument is disabled. When any of "Automatic Start," "Self-training Software," and "Network" capabilities is selected and, if no ID number is entered, the selected capability operates by default setting. If the ID number is entered and recognized, the selected capability operates in a mode matching the personal information corresponding to the entered ID number as in the above-mentioned automatic start.

Figure 10:
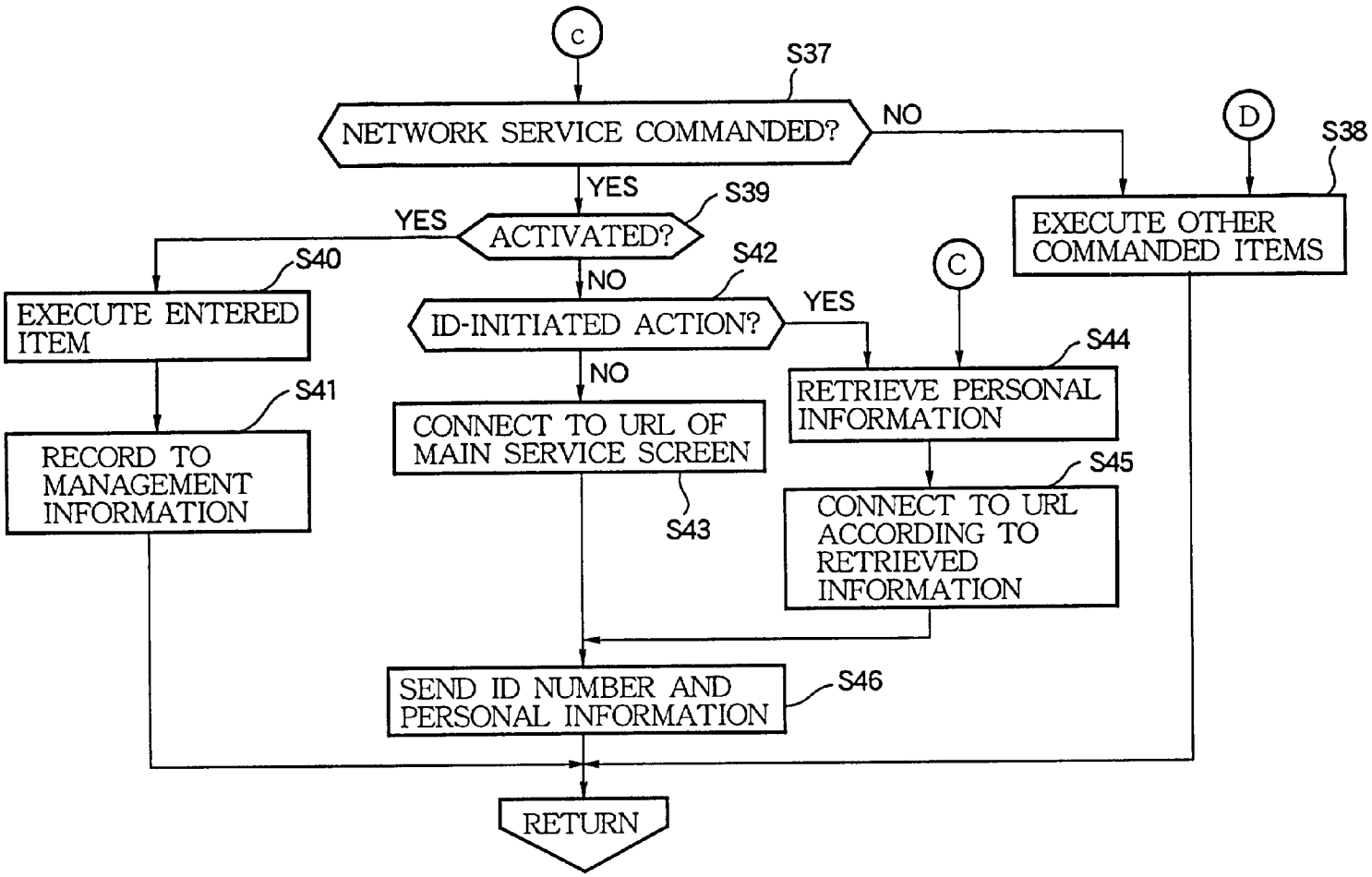
FIG. 10 is a flowchart associated with a network service capability in the panel setting processing in the first embodiment.
Figure 11:
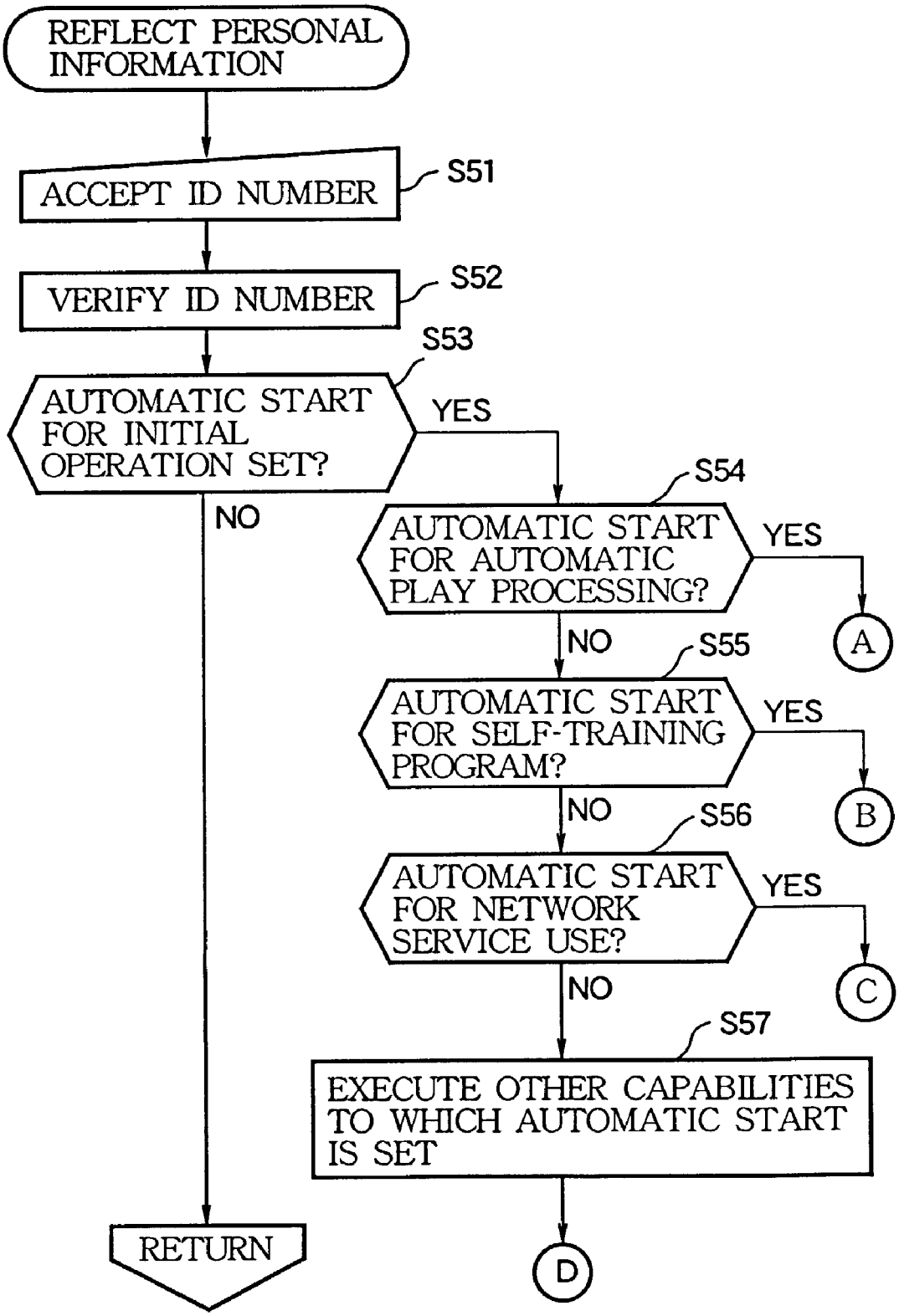
FIG. 11 is a flowchart describing the processing of reflecting personal information in the fist embodiment.
Figure 12:
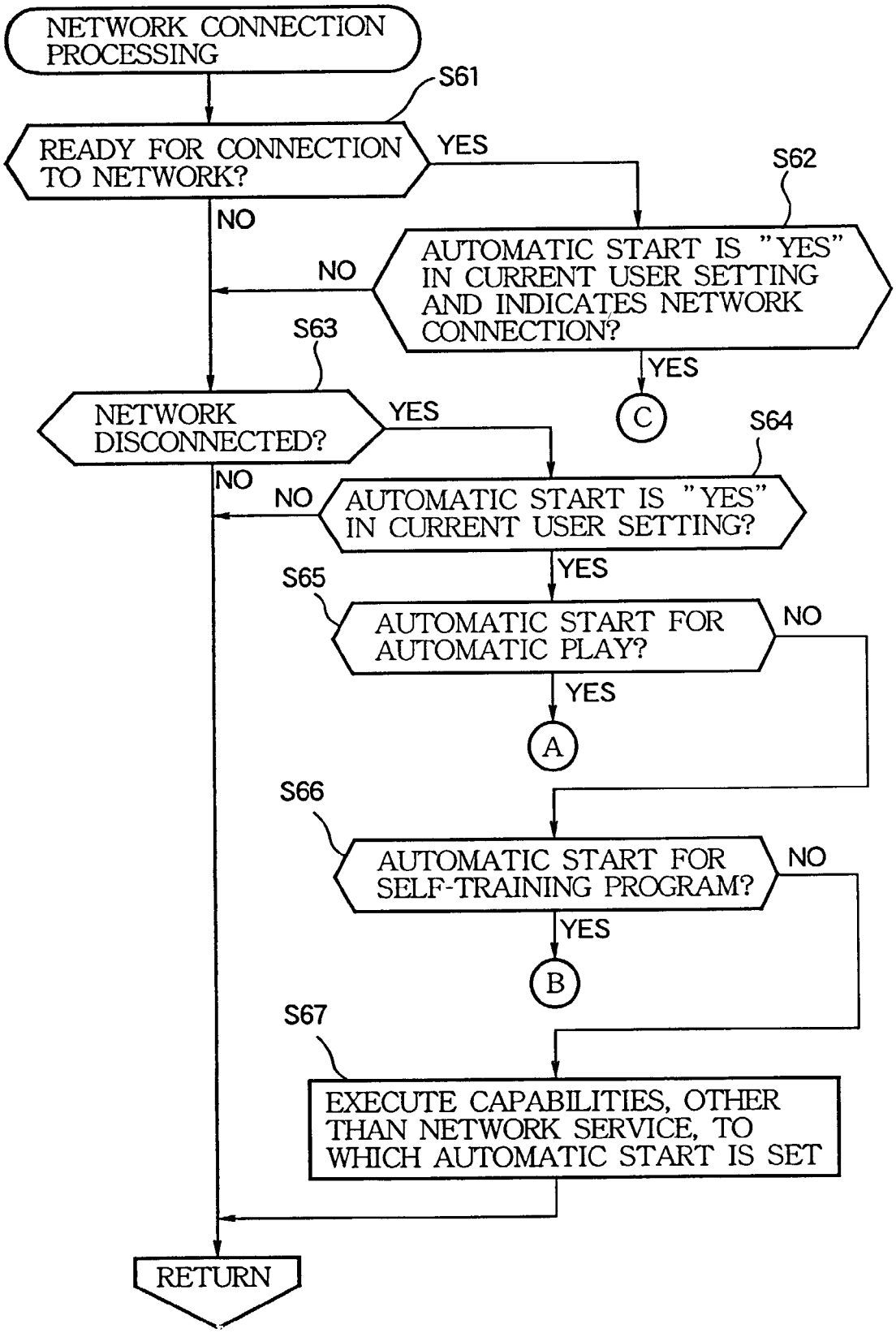
FIG. 12 is a flowchart describing the network connection processing in the first embodiment.

FIGS. 6 through 12 are flowcharts describing the main operation of the control program executed by the CPU 1. The following describes the control operation of the CPU 1 with reference to these flowcharts. In the main processing shown in FIG. 6, various flags and buffers are reset and the above-mentioned initial input screen is initialized in step S1. In step S2, on the basis of the panel setting processing shown in FIGS. 7 through 10, input processing in the initial input screen and processing for accepting switch operations done on the panel controls 5 for example are executed. In step S3, the processing for network connection shown in FIG. 12 is executed. In step S4, play input processing such as the detection of a play command issued from the play controls 4 and the retrieval of automatic play data is executed. In step S5, play processing such as the generation and output of waveform signals corresponding to the above-mentioned play command and automatic play data is executed. Then, the procedure returns to step S2.

Figure 7:
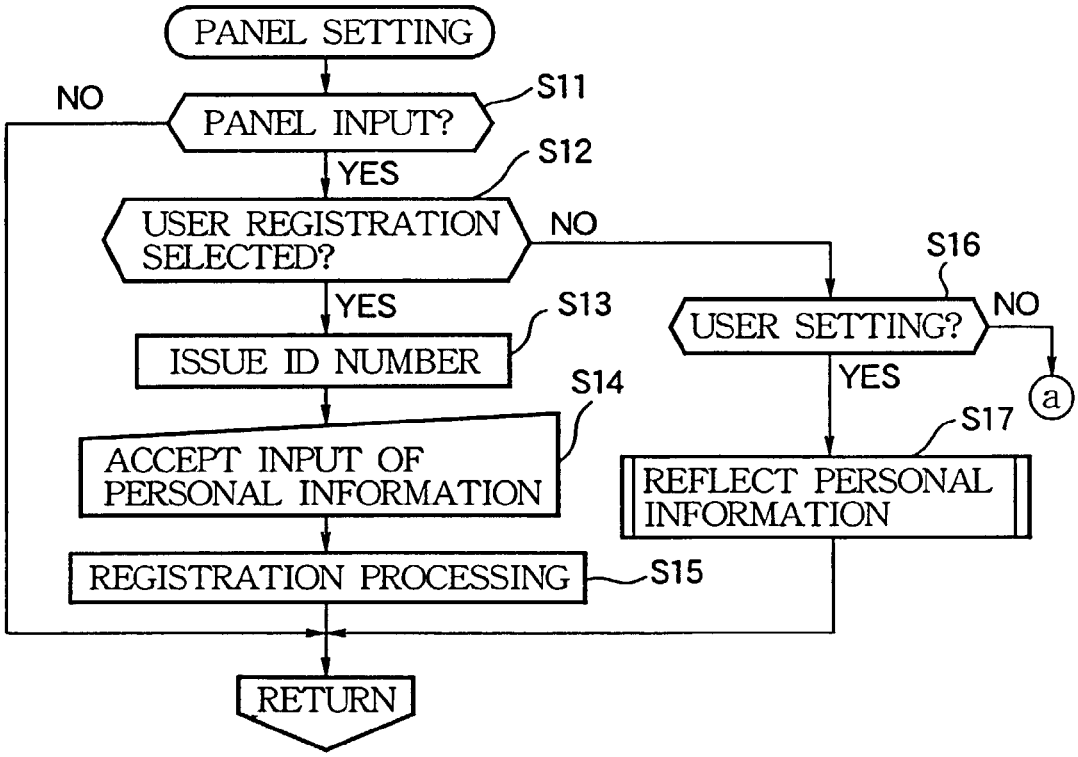
FIG. 7 is a flowchart associated with panel setting processing in the first embodiment.

In the panel setting processing shown in FIG. 7, it is determined whether or not an entry has been made on the panel controls 5 in step S11. If no entry is found, the procedure returns to the main routine. If an entry is found, then whether or not "User Registration" (FIG. 4) has been selected is determined in step S12. If "User Registration" is selected, then an ID number is issued (shown in display box B1 shown in FIG. 5) in step S13. In step S14, the entry of personal information is accepted. In this acceptance processing, entry of "0" (the mode of usual initial start) or an ID number into display box B1 shown in FIG. 5 or entry of personal information into input box B2 is executed. In step S15, registration processing is executed, upon which the procedure returns to the main routine. It should be noted that, in this registration processing, the entered personal information is stored in correspondence with the ID number.

If "User Registration" is not selected in step S12, then whether or not "User Setting" has been selected is determined in step S16. If "User Setting" is found selected, then the setting shown in FIG. 11 is made in step S17 by reflecting the entered personal information, upon which the procedure returns to the main routine. If "User Setting" is found not selected, the procedure goes to step S18 shown in FIG. 8.

In the following steps, whether or not an "Automatic Play" command, a "Self-training Software" command, and a "Network Service" command have been issued is determined. These commands include the operations of the "Automatic Play" switch SW3, the "Self-training Software" switch SW4, and the "Network" switch SW5 shown in FIG. 4, and operations of other switches on the screens and the corresponding panel controls 5 which are operated after the switches SW3, SW4, and SW5.

Figure 8:
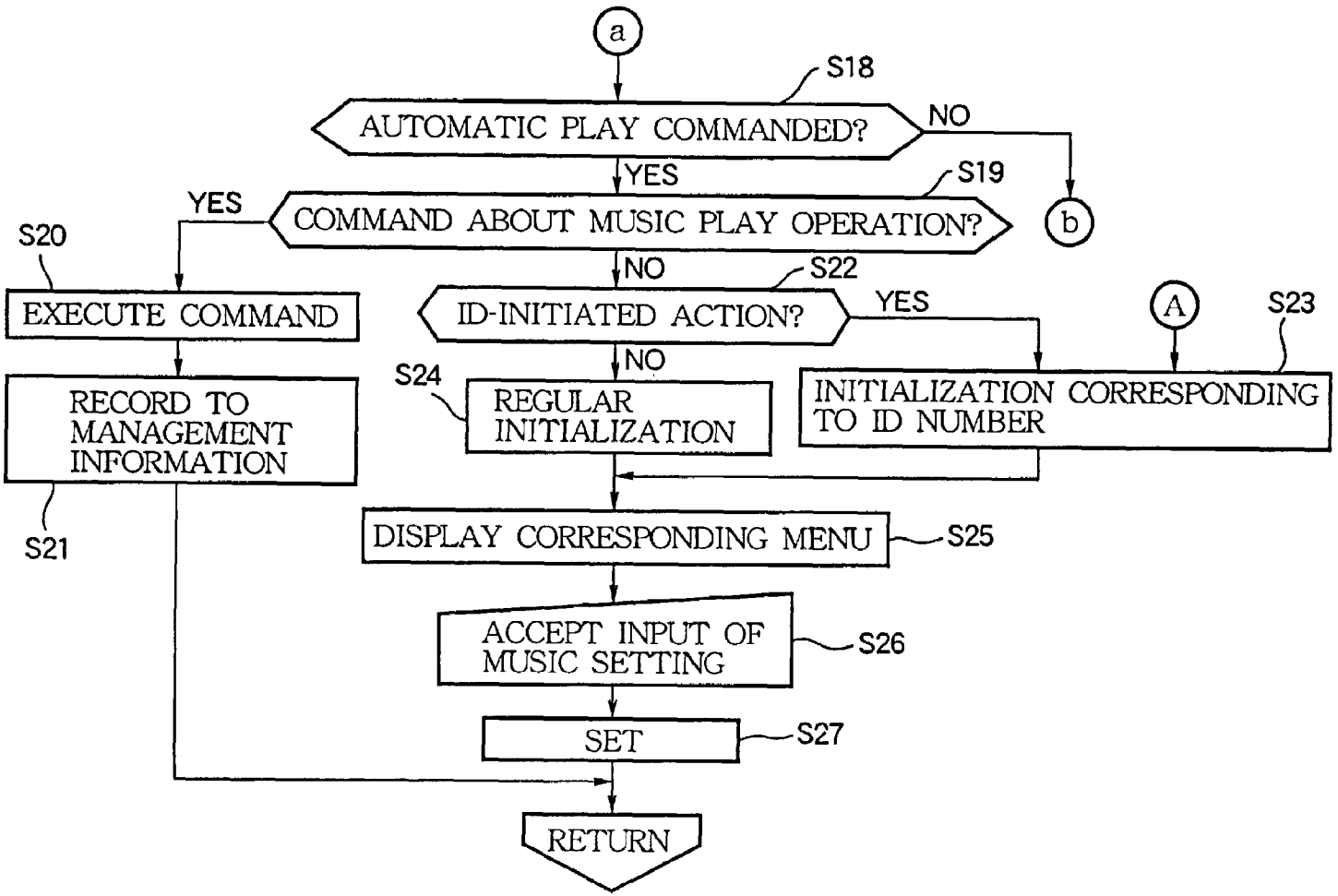
FIG. 8 is a flowchart associated with an automatic play capability in the panel setting processing in the first embodiment.

In step S18 shown in FIG. 8, it is determined whether or not the "Automatic Play" command has been issued. If the "Automatic Play" command has not been issued, then the procedure goes to step S28. If the "Automatic Play" has been issued, then whether or not this command is associated with a music play operation such as reproduction or stop is determined in step S19. If the command is found associated with the music play operation, the command is executed in step S20. In step S21, the execution of this command is recorded to the management information, upon which the procedure returns to the main routine. If the command is found not associated with the music play operation in step S19, then it is determined whether or not Id-initiated action is on in step S22. Id-initiated action denotes a state in which an ID number has been entered and recognized. If Id-initiated action is found on, then an initialization corresponding to the ID number is executed in step S23 and the procedure goes to step S25. In the initial setting corresponding to the ID number, automatic play is initialized by retrieving a log of music pieces automatically played so far with this ID number and by searching candidate of music pieces in a genre of preference specified by the personal information corresponding to the ID number for example. If Id-initiated action is not found in step S22, then a regular or default initialization is executed on automatic play in step S24 and the procedure goes to step S25.

In step S25, a menu representative of titles for example of automatic play music is displayed. In step S26, an entry of music setting for selecting a music piece is accepted. In step S27, the play data of the selected music are loaded into a memory to set the start address of the play data, upon which the procedure returns to the main routine. It should be noted that this setting allows the acceptance of the command associated with the play operation and, when this command is accepted, the processes shown in steps S20 and S21 are executed.

Figure 9:
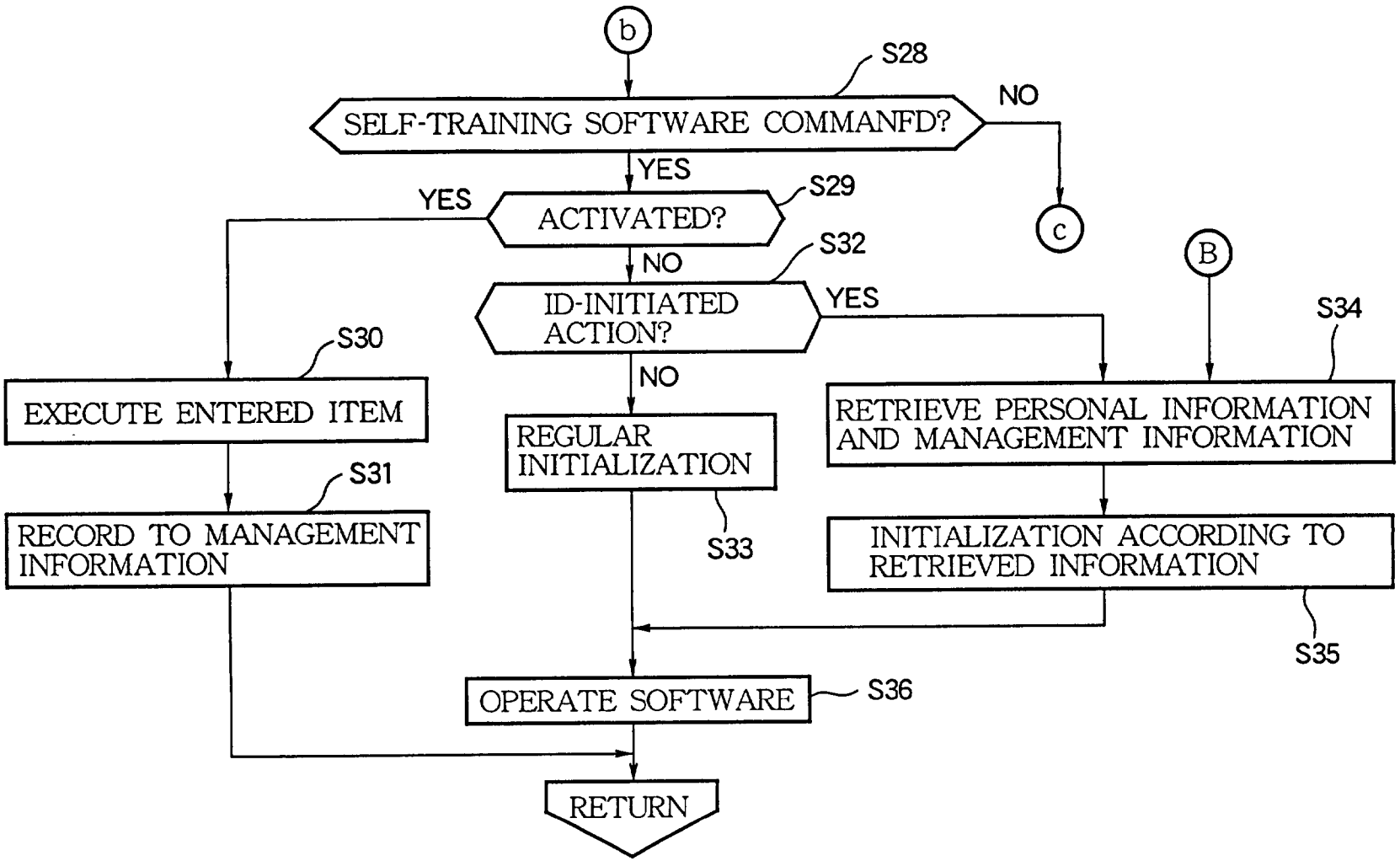
FIG. 9 is a flowchart associated with a self-training capability in the panel setting processing in the first embodiment.

In step S28 shown in FIG. 9, it is determined whether or not a "Self-training Software" command has been issued. If no "Self-training Software" command has been issued, then the procedure goes to step S37 shown in FIG. 10. If a "Self-training Software" command is found, it is checked whether or not the self-training software has already been started in step S29. If the self-training software is found started, then the command is executed in step S30. In step S31, the execution of the command is recorded to the management information, upon which the procedure returns to the main routine. If the self-training software is not started in step S29, then it is checked whether or not Id-initiated action is on in step S32. If Id-initiated action is found not on, then a regular initialization is performed on the self-training software in step S33 and the self-training software is operated in step S36, upon which the procedure returns to the main routine.

On the other hand, if Id-initiated action is found on in step S32, then the personal information and management information corresponding to the ID number are retrieved in step S34. In step S35, the initialization corresponding to the retrieved information is executed. In step S36, the self-training software is run, upon which the procedure returns to the main routine. In this initialization corresponding to the retrieved information, the difficulty level of the self-training software is automatically set to match user's playing skill in consideration of the genre of preference, the number of lessons, and lesson duration of time of the user. Also automatically set are the titles of music with this difficulty level considered, the constitution (tempo and degree of accompaniment for example) of music with this difficulty considered, music of user's preference, parts of user's preference, and self-training software support modes (for example, fingering, keyboard guidance, and others). Moreover, the play data and score data of lesson music are retrieved to make the play data and score data available for the self-training software and to display music candidates for example.

In step S37 shown in FIG. 10, it is determined whether or not a "Network Service" command has been issued. If a "Network Service" command has not been issued, then other commands are executed in step S38, upon which the procedure returns to the main routine. If a "Network Service" command has been issued, whether or not the network service has already been started is determined in step S39. If the network service is found started, then the issued command is executed in step S40. In step S41, the execution of the command is recorded to the management information, upon which the procedure returns to the main routine. If the network service is found not started in step S39, then whether or not Id-initiated action is on is determined in step S42. If Id-initiated action is not on, the URL of the main server screen is accessed in step S43. In step S46, the ID number and the personal information are sent, upon which the procedure returns to the main routine.

On the other hand, if Id-initiated action is found on in step S42, then the personal information corresponding to the ID number is retrieved in step S44. In step S45, the URL corresponding to the retrieved personal information is accessed. In step S46, the ID number and the personal information are sent, upon which the procedure returns to the main routine. To access the URL corresponding to the retrieved personal information, a search is made, on the basis of information such as user's age and genre of preference for example, for a site which provides music information suitable for the user, and the URL of such a site is automatically accessed.

In the processing of reflecting the personal information shown in FIG. 11, "User Setting" shown in FIG. 4 is selected and executed in step S17 shown in FIG. 7. First, in step S51, the input of ID number is accepted. In step S52, the ID number is verified. If the ID number is not registered, a warning message is displayed, thereby causing the procedure to forcibly return to the main routine for example. If the entered ID number is found registered, then it is checked whether or not the automatic start of the initial operation is set (the setting of "Yes" in input box B1 and "Contents" shown in FIG. 5) in step S53. If the automatic start is found not set, then the procedure returns to the main routine.

If the automatic start is found set, then it is checked whether or not this automatic start is for automatic play processing in step S54. If the automatic start is associated with the automatic play processing, then the procedure goes to step S23 shown in FIG. 8; otherwise, the procedure goes to step S55 in which whether or not the automatic start is for the self-training software is determined. If the automatic start is associated with the self-training software, then the procedure goes to step S34; otherwise, the procedure goes to step S56 in which whether or not the automatic start is for the network service is determined. If the automatic start is associated with the network service, then the procedure goes to step S44 shown in FIG. 10; otherwise, the procedure goes to step S57 in which other processing for which the automatic start is set is executed, upon which the procedure goes to step S38 shown in FIG. 10.

The above-mentioned processing corresponds to the setting operation executed by the user as follows. When "User Registration" (FIG. 4) is selected, the ID number and the personal information may be registered in steps S12 through S15 shown in FIG. 7. It should be noted that this registration may only be made once, or the registration made once may be changed as required. When "User Setting" (FIG. 4) is selected after the registration and the ID number is set in steps S17 (steps S51 and S52 in FIG. 11) shown in FIG. 7, Id-initiated action is turned on. Then, if the automatic start is not set, selection of "Automatic Play" (FIG. 4) automatically executes the setting for automatic play suitable for the user in steps S23 and S25 through S27 shown in FIG. 8. Selection of "Self-training Software" (FIG. 4) automatically executes the setting for the self-training software suitable for the user in steps S34 through S36 shown in FIG. 9. Further, selection of "Network" (FIG. 4) automatically executes the setting for the network service suitable for the user in steps S44 through S46 shown in FIG. 10.

If automatic start is set, each capability automatically starts, at the time the ID number is entered in "User Setting,"

in the steps of S54 through S57 shown in FIG. 11 and the corresponding steps in FIGS. 8 through 10, under the mode set by the user, and by the setting suitable for the user.

The processing for network connection shown in FIG. 12 is executed in correspondence to step S3 of the main routine. In step S61, it is determined whether or not the electronic musical instrument is connectable to the network. If the electronic musical instrument is found connectable, then the procedure goes to step S62; otherwise, the procedure goes to step S63. In step S62, it is determined whether or not the automatic start in the current user setting is "Yes" and the automatic start is associated with the network connection. If the decision is No, then the procedure goes to step S63; if the decision is Yes, the procedure goes to step S44 shown in FIG. 10.

In step S63, whether not the network has been disconnected is determined. If the network is disconnected, then the procedure returns to the main routine; otherwise, it is checked whether or not the automatic start in the current user setting is "Yes" in step S64. If the automatic start is found not "Yes," then the procedure returns to the main routine. If the automatic start is found "Yes," then whether or not the automatic start is for automatic play processing is determined. If the automatic start is associated with the automatic play processing, then the procedure goes to step S23 shown in FIG. 8. If the automatic start is not associated with the automatic play processing, then it is checked whether or not the automatic start is for the self-training software in step S66. If the automatic start is associated with the self-training software, then the procedure goes to step S34 shown in FIG. 9. If the automatic start is not associated with the self-training software, then other processing than the network processing, to which the automatic start is set, is executed, upon which the procedure returns to the main routine.

If the automatic start is set for the network connection by user registration and if the network connection is set in the usual initial start mode with no user ID registered, the electronic musical instrument 300 is connected to a URL suitable for the user when a new network connection is detected in the electronic musical instrument 300 in step S62 and steps S44 through S46 shown in FIG. 10. If the electronic musical instrument 300 is disconnected from the network, various capabilities other than the network connection automatically start.

(Second Embodiment)

Figure 13:
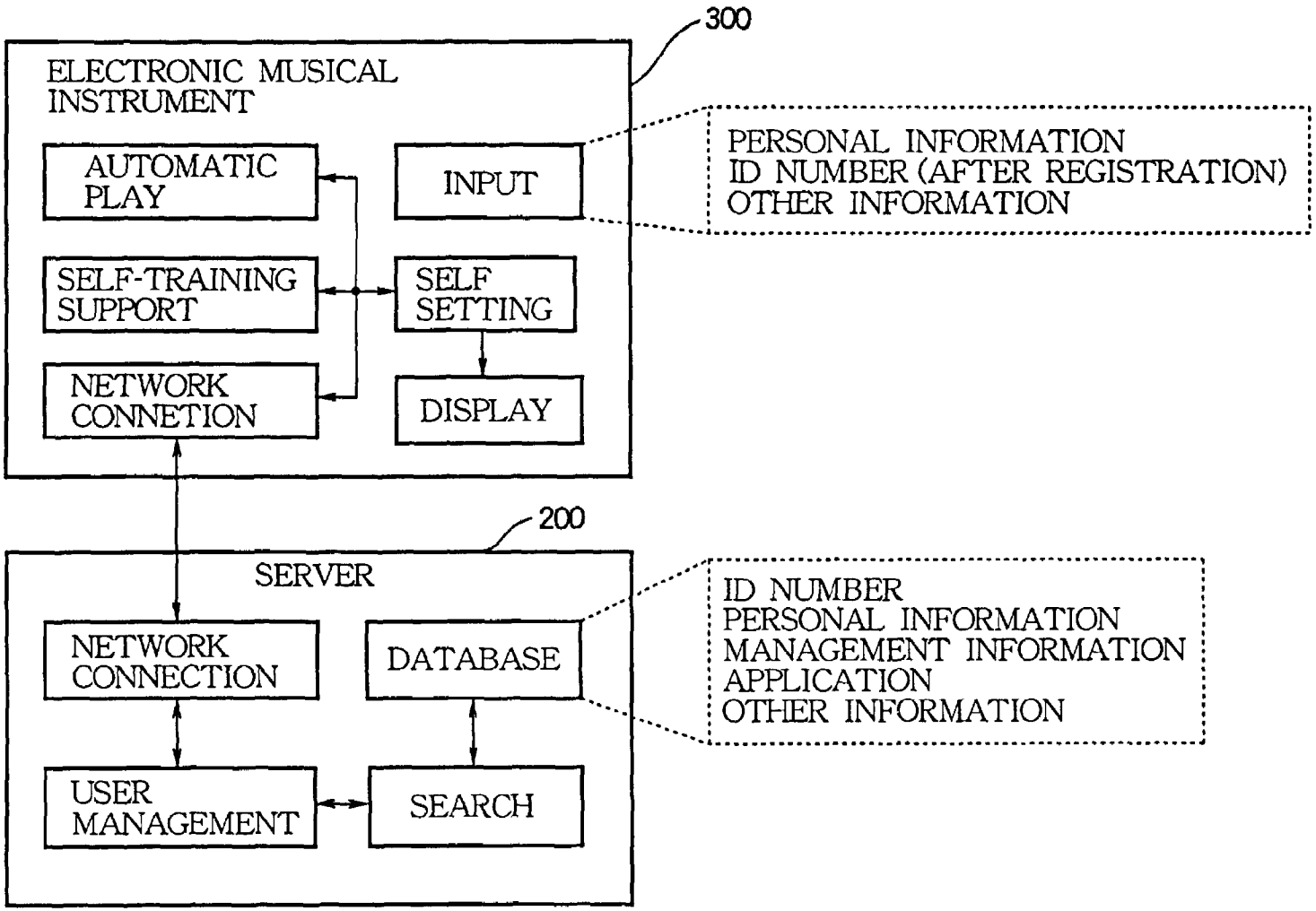
FIG. 13 is a functional block diagram illustrating the main configuration of a second embodiment.

Referring to FIG. 13, there is shown a block diagram illustrating the main configuration of a second embodiment. The second embodiment is intended to realize substantially the same functionality as that of the first embodiment by performing information transfer between an electronic musical instrument 300 and a server 200 through a network 100 as shown in FIG. 13.

More specifically, as with the first embodiment, the electronic musical instrument 300 has an automatic play capability, a self-training support capability, and a network connection capability, the details of these capabilities being set by a self setting capability. The setting contents are substantially the same as those of the first embodiment. An input capability is realized by a Web page for example set by the server 200, through which ID numbers and personal information are entered as with the first embodiment.

The server 200 is a particular server computer connected to the network 100. A database of this server stores registered ID numbers, personal information associated with each ID number, management information associated with each ID number, application software including self-training software, and other information. The server 200 has also a CPU for executing a program composed of processing steps described with reference to FIGS. 7 through 11. The server 200 searches its database by use of user management and search capabilities for the personal information and management information corresponding to each ID number entered from the electronic musical instrument 300, thereby setting various capabilities in accordance with these personal information and management information to the electronic musical instrument 300.

The following describes the relationships between the various capabilities set to the electronic musical instrument 300 and the personal information by use of an example. In the database (in the first embodiment, the database of the electronic musical instrument 300; in the second embodiment, the database of the server 200), a plurality of tables are arranged, from which a table matching the specific personal information is selected; for example, if personal information indicates "male, age 45, jazz, music A, . . . " for example, table 1 is selected. If personal information indicates "female, age 18, classics, music B, . . . " for example, table 2 is selected. It should be noted that, even if one piece of personal information differs in contents from another piece of personal information, the same table may be selected incidentally. Each table contains data corresponding to the automatic play, self-training software, and network service capabilities.

For example, in the case of the automatic play capability, music titles and genres (recommended music, etc.) and play modes (sequential, random, etc.) are set. In the case of the above-mentioned table 1, the automatic play capability of the electronic musical instrument 300 is set as "Music Title List (1), random play, . . . " In the case of the self-training software, music title, tempo, part, play mode (length of repetition), and lesson time, for example are set. In the case of the above-mentioned table 1, the self-training software capability of the electronic musical instrument 300 is set as "music A, 120, piano, repeat, 20 minutes" for example.

In the case of the network service capability, the electronic musical instrument 300 can automatically access to particular URL of user preference and to send own data to the accessed site to get desired services therefrom. The network service capability allows the electronic musical instrument 300 to transfer music data, score data, music information, concert information, club information, and play start information, for example, to provide the services suitable to the user. For example, in the case of table 1, the electronic musical instrument 300 receives Blue Note concert information, a purchase screen of music title list A, and club information.

As described above, a user profile may be set at the time of using the musical instrument for example. To be more specific, attributes such as father, mother, son, daughter, and age and music and genres of preference may be set to the musical instrument or the server. Every time the musical instrument is played, the user starts (or logs in) with his or her own profile, thereby registering a play log and a lesson count for example as a record. With the self-training software or a remote lesson with the musical instruction connected to the network, this profile may be used to introduce optimum content or to automatically upgrade the lesson from the application or server in accordance with individual user skill and genre of user preference for example.

In the first embodiment, the electronic musical instrument 300 is connected to the network 100. The present invention is also applicable to an example in which the electronic musical instrument 300 is connected to the computer 400, which is connected to the network 100.

As described and according to the invention, the electronic musical instrument allows the user to enter his or her ID information to operate the electronic musical instrument with the capabilities suitable for the user, thereby enhancing user friendliness.

The inventive electronic musical instrument allows the user to set more definite personal information.

The inventive electronic musical instrument allows the storage of a play log such as the number of times that the lessons have been practiced.

The inventive electronic musical instrument operates the training capability with a training level suitable for the user in accordance with a user's self evaluation level and the number of times that the lessons have been practiced, thereby automatically upgrading the training level in accordance with user's skill.

The inventive network system allows the user to enter his or her ID information to operate the electronic musical instrument with the capabilities suitable for the user, thereby further enhancing user friendliness.

The inventive network system allows the user to operate the electronic musical instrument with the capabilities suitable for the user, thereby enhancing user friendliness.

The inventive network system allows the storage of a play log such as the number of times that the lessons have been practiced.

The inventive network system operates the training capability (or lesson software) with a training level suitable for the user in accordance with the personal information such as the user's self evaluation level and the number of times that the lessons have been practiced, thereby automatically upgrading the training level in accordance with user's skill.

What is claimed is:

1. An electronic musical instrument operable to provide a music play and a plurality of capabilities utilized by users in association with the music play under different modes customized to the respective users, the electronic musical instrument comprising:

an ID setting section that sets identification information effective to identify each of the users;

a managing section that manages personal information containing a profile of each user in correspondence to the identification information of each user, wherein the managing section can include automatic start information in the personal information, the automatic start information specifying a desired capability to be automatically activated at start of the electronic musical instrument; and a capability activating section that is operative when identification information of a particular user is designated for activating one of the capabilities under a mode customized for the particular user according to the personal information corresponding to the designated identification information, wherein the capability activation section operates when the personal information corresponding to the designated identification information includes the automatic start information for automatically activating the desired capability specified by the automatic start information as the one of the capabilities at the start of the electronic musical instrument.

2. The electronic musical instrument according to claim 1, further comprising an input section that is operated by the user for inputting the personal information of the user to the managing section.

3. The electronic musical instrument according to claim 1, wherein the managing section manages the personal information containing a log of sessions of the music play rendered by the user such that the sessions are counted into the personal information for use in customizing of the mode of the capability.

4. The electronic musical instrument according to claim 1, wherein the capability activating section activates a training capability effective to assist in self-training of the music play under the mode customized to a training level of the particular user based on the personal information.

5. The electronic musical instrument according to claim 1, wherein the capability activating section activates an automatic play capability effective to provide an automatic music play under the mode customized to a preference of the particular user based on the personal information.

6. A system comprising a plurality of electronic musical instruments connected to a network, and a server for serving the electronic musical instruments through the network, wherein the electronic musical instruments are operable by users to provide a music play and a plurality of capabilities utilized by users in associated with the music play under different modes customized to the respective users, and wherein the server comprises:

a registering section that registers identification information effective to identify each of the users;

a managing section that manages personal information containing a profile of each user in correspondence to the identification information of each user, wherein the managing section can include automatic start information in the personal information, the automatic start information specifying a desired capability to be automatically activated at start of the electronic musical instrument; and a configurating section that operates when identification information of a particular user is designated for configurating the electronic musical instrument of the particular user to activate the capability under a mode customized for the particular user according to the personal information corresponding to the designated identification information, wherein the capability activation section operates when the personal information corresponding to the designated identification information includes the automatic start information for automatically activating the desired capability specified by the automatic start information as the one of the capabilities at the start of the electronic musical instrument.

7. The system according to claim 6, wherein the electronic musical instrument has an input section that is operated by the user for inputting the personal information of the user to the server.

8. The system according to claim 6, wherein the managing section manages the personal information containing a log of sessions of the music play rendered by the user such that the sessions are counted into the personal information for use in customizing of the mode of the capability.

9. The system according to claim 6, wherein the configurating section configurates the electronic musical instrument to activate a training capability effective to assist in self-training of the music play under the mode customized to a training level of the particular user based on the personal information.

10. The system according to claim 6, wherein the configurating section configurates the electronic musical instrument to activate an automatic play capability effective to provide an automatic music play under the mode customized to a preference of the particular user based on the personal information.

11. A method of operating an electronic musical instrument to provide a music play and a plurality of capabilities utilized by users in association with the music play under different modes customized to the respective users, the method comprising the steps of:

setting identification information effective to identify each of the users;

managing personal information containing a profile of each user in correspondence to the identification information of each user, wherein the managing section can include automatic start information in the personal information, the automatic start information specifying a desired capability to be automatically activated at start of the electronic musical instrument; and activating the capability when identification information of a particular user is designated, in a mode customized for the particular user according to the personal information corresponding to the designated identification information, wherein the capability activation section operates when the personal information corresponding to the designated identification information includes the automatic start information for automatically activating the desired capability specified by the automatic start information as the one of the capabilities at the start of the electronic musical instrument.

12. A method of serving a plurality of electronic musical instruments by a server through a communication network, the electronic musical instruments being operable by users to provide a music play and an associated capability utilized by users in association with the music play under different modes customized to the respective users, the method comprising the steps of:

registering identification information effective to identify each of the users;

managing personal information containing a profile of each user in correspondence to the identification information of each user, wherein the managing section can include automatic start information in the personal information, the automatic start information specifying a desired capability to be automatically activated at start of the electronic musical instrument; and configurating the electronic musical instrument of a particular user when identification information of the particular user is designated for activating the capability under a mode customized to the particular user in accordance with the personal information corresponding to the designated identification information, wherein the capability activation section operates when the personal information corresponding to the designated identification information includes the automatic start information for automatically activating the desired capability specified by the automatic start information as the one of the capabilities at the start of the electronic musical instrument.

13. A program executable by a CPU of an electronic musical instrument to provide a music play and an associated capability utilized by users in association with the music play under different modes customized to the respective users, the program comprising code stored on a computer-readable medium in executable form so as to cause the CPU to perform the steps of:

setting identification information effective to identify each of the users;

managing personal information containing a profile of each user in correspondence to the identification information of each user, wherein the managing section can include automatic start information in the personal information, the automatic start information specifying a desired capability to be automatically activated at start of the electronic musical instrument; and activating the capability when identification information of a particular user is designated, in a mode customized for the particular user according to the personal information corresponding to the designated identification information, wherein the capability activation section operates when the personal information corresponding to the designated identification information includes the automatic start information for automatically activating the desired capability specified by the automatic start information as the one of the capabilities at the start of the electronic musical instrument.

14. A program executable by a server for serving a plurality of electronic musical instruments through a communication network, the electronic musical instruments being operable by users to provide a music play and an associated capability utilized by users in association with the music play under different modes customized to the respective users, the program comprising code stored on a computer-readable medium in executable form so as to cause the CPU to perform the steps of:

registering identification information effective to identify each of the users;

managing personal information containing a profile of each user in correspondence to the identification information of each user, wherein the managing section can include automatic start information in the personal information, the automatic start information specifying a desired capability to be automatically activated at start of the electronic musical instrument; and configurating the electronic musical instrument of a particular user when identification information of the particular user is designated for activating the capability under a mode customized to the particular user in accordance with the personal information corresponding to the designated identification information, wherein the capability activation section operates when the personal information corresponding to the designated identification information includes the automatic start information for automatically activating the desired capability specified by the automatic start information as the one of the capabilities at the start of the electronic musical instrument.

* * * * *